United States Patent [19]

Filko et al.

[11] 4,023,720

[45] May 17, 1977

[54] GLOVE TURNING AND BLOCKING PROCESS AND APPARATUS

[75] Inventors: Colin Filko; Richard Stanley Smith; Lawrie Gandier McIntosh, all of Winnipeg, Canada

[73] Assignee: Sterling Glove Co., Ltd., Winnipeg, Canada

[22] Filed: Dec. 1, 1975

[21] Appl. No.: 636,590

[52] U.S. Cl. ..... 223/40

[51] Int. Cl.² ..... A41H 43/00

[58] Field of Search ..... 223/78, 80, 57, 39, 223/40, 41, 83, 51, 52

[56] References Cited

UNITED STATES PATENTS

| | | | |
|---|---|---|---|
| 2,434,816 | 1/1948 | Suftko | 223/40 |
| 2,510,341 | 6/1950 | Keller | 223/40 |
| 2,513,612 | 7/1950 | Alberding | 223/40 |
| 3,010,622 | 11/1961 | Parrish | 223/78 |
| 3,738,547 | 6/1973 | Horton | 223/40 |

*Primary Examiner*—G. V. Larkin

*Attorney, Agent, or Firm*—Robert G. Hirons

[57] ABSTRACT

A process of simultaneously turning and blocking a leather glove is disclosed, in which the fingers of the glove are initially mounted upon elongated members of relatively small diameter, and are turned onto heated mandrels of relatively larger diameter. The stretching of the finger portions as they are turned in this manner, combined with the application of heat from the heated mandrels, causes simultaneous blocking of the glove fingers as they are turned. In an apparatus for carrying out this process, the finger receiving members of lesser diameter are rods, and the mandrels onto which the fingers are turned are tubular. A wrist clamp is provided, which grips the inside of the cuff portion of the glove, and draws the glove off the finger mounting members onto the heated mandrels by movement relative to the finger mounting members. The turning of the glove fingers is assisted by the provision of retractable inserts in the tubular mandrels, which push on the finger ends to assist the pulling forces exerted by the moving wrist clamp to effect the turning.

18 Claims, 12 Drawing Figures

GLOVE TURNING AND BLOCKING PROCESS AND APPARATUS

BACKGROUND OF THE PRESENT INVENTION

This invention relates to methods and apparatus for making gloves. More particularly, it relates to a method of and apparatus for turning stitched leather gloves from their inside out condition in which they are stitched, to their finished condition, and for flattening the stitched seams of the gloves which are consequently disposed inside the fingers of the finished glove.

Gloves of leather and similar pre-formed materials are made by stitching together pre-cut pieces of the material. Since it is desirable that in the finished glove the stitched seams should be out of the way and not visible, for functional and/or aesthetic reasons, a leather glove is stitched together inside out, with the seams projecting outwardly, and then reversed so that the seams will be disposed inside the finished glove. In order that the glove may be worn comfortably, the seams inside the fingers of the gloves should not project inwardly to any great extent. It is therefore necessary to flatten the stitched seams. This is normally done after the glove is turned from its inside out condition, and is referred to in the art as blocking the glove.

Thus after a leather glove has been stitched together, there are the turning and blocking operations to be performed, before the glove is finished. Due to the relatively complex structure of a glove, with its finger, hand and cuff parts of different shapes, the turning and blocking operations do not readily lend themselves to performance by mechanical means in a simple, rapid and effective manner.

BRIEF DESCRIPTION OF THE PRIOR ART

It has previously been proposed to turn a stitched leather glove from inside out condition to right side out condition by mounting the inside out glove on an apparatus comprising tubular finger members which extend inside the glove fingers. Then rods or plungers are pushed down inside the tubes to reverse the fingers of the glove so that the fingers of the glove lie between the inside of the tubular finger members and the outside of the plungers, in their right side out condition. The cuff portion of the glove is gripped by hand or clamping means, and drawn upwardly over the tubular finger members so as to complete the turning of the glove. Examples of this type of glove turning apparatus are described in U.S. Pat. No. 3,738,547, Horton, U.S. Pat. No. 2,540,503, Becker, U.S. Pat. Nos. 2,286,057 and 2,286,058, Brownstein, U.S. Pat. No. 2,434,816, Suftko, U.S. Pat. No. 2,510,341, Keller and U.S. Pat. No. 978,434, Crosby.

In such glove turning processes and apparatus, however, considerable amounts of force have to be exerted to turn the fingers of the glove. This entails a substantial risk that the glove will be torn or otherwise damaged during the turning operation. Further, blocking of the glove is effected as a separate operation, either using separate apparatus, or using apparatus constituting a separate and distinct stage of a combined turning and blocking apparatus. Blocking of a leather glove is accomplished by applying heat to the seam in a forcibly flattened condition, substantially equivalent to ironing of textiles. Blocking is a time consuming process. In such prior art processes, the glove has to be held in the seam flattened condition at a temperature of about 300° F for a period of about 2 minutes, to accomplish the necessary blocking. This is a limitation in the production capacity of conventional leather glove making processes.

BRIEF SUMMARY OF THE INVENTION

An object of the present invention is to provide an improved process and apparatus for turning and blocking gloves of leather and the like materials.

A further object of the invention is to provide a glove finishing process in which turning and blocking of the glove is accomplished substantially simultaneously, as a single operation.

A further object of the invention is to provide a novel apparatus which will perform substantially simultaneous turning and blocking of leather and the like gloves.

Briefly stated, the objects of the present invention are accomplished by a process in which a stitched leather glove is initially mounted with at least one finger thereof, in an inside out condition, over a relatively small diameter finger mounting member, and then the glove finger is turned to right side out by rolling the glove finger onto the exterior surface of a relatively larger diameter finger receiving mandrel. Preferably there is substantially simultaneous application of heat to the glove finger, as it is turned. The turning of the glove by this process causes the necessary pressing under heat of the glove seams to effect blocking of the glove as it is turned.

Apparatus for turning and blocking gloves according to the present invention comprises:

at least one finger mounting member of relatively small diameter adapted to be received inside a finger of a stitched inside out glove mounted thereon;

at least one finger receiving mandrel of relatively larger diameter adapted to be arranged in substantial longitudinal alignment with said at least one finger mounting member;

means for engaging a glove mounted on said at least one finger mounting member and transferring said glove finger by rolling it onto the outer surface of said at least one finger receiving mandrel.

A preferred apparatus according to the present invention comprises four finger mounting members and four finger receiving mandrels adapted to be arranged in substantial alignment therewith, with means for heating each mandrel. Such an apparatus simultaneously turns and blocks the four fingers of a glove which can be arranged to extend substantially parallel to one another from the hand portion of the glove. A further apparatus according to the invention comprises a single finger mounting member and a single finger receiving mandrel adapted to be arranged in substantial alignment therewith. Such apparatus can be used to turn and block simultaneously the thumb or an individual finger of a glove.

It has been found that, when a glove is turned by the process or using the apparatus of the present invention, there is exerted sufficient stretching and pressing of the stitched seams to effect blocking of the glove as it is turned. The blocking is achieved by the stretching of the glove finger as it is rolled or turned onto a larger diameter mandrel, and by the application of heat while it is in its thus stretched condition. The heat is best supplied by heating the larger diameter finger receiving mandrel, with which the glove finger and its seams come into intimate contact in the stretched condition.

It has been found that about 75% of the desired blocking can be accomplished by the actual turning of the glove in accordance with the process of the invention. The remainder of the blocking is accomplished by retaining the glove on the larger heated finger receiving mandrel, for a brief period.

The prior art arrangements are unable to achieve this simultaneous blocking and turning, since they turn a glove finger from the outside of a relatively larger diameter tube onto a relatively smaller diameter rod or plunger inserted down the inside of the tube. Such turning action is accompanied by a general compression of the glove finger, not a stretching, and such compression is incompatible with blocking the glove finger at the same time. The subsequent step of blocking the glove which is required is not only more time consuming because it is a separate stage of the entire process, but is a more time consuming operation in itself. The combined blocking and turning operation according to the present invention can be accomplished in about 10–15 seconds in practice, whereas conventional separate blocking operations normally take of the order of 2 minutes to complete.

DESCRIPTION OF THE PREFERRED EMBODIMENTS

The finger mounting members of smaller diameter are preferably rods, and the finger receiving mandrels are preferably hollow or tubular, and arranged to be movable so that the finger receiving mandrels will snugly surround the finger mounting members and the glove fingers mounted thereon. The means for engaging the glove is suitably an expandable and retractable wrist clamp, arranged to move longitudinally with respect to the finger receiving mandrels and to surround them. The wrist clamp is expanded to engage the inside of the cuff or wrist portion of the glove. It is then moved longitudinally of the finger receiving mandrels to draw the cuff and hand parts of the glove over the finger receiving mandrels and turn them right side out as it does so. As its travel continues, the wrist clamp turns the fingers of the glove by rolling them from their initial inside out engagement with the finger mounting members into their right side out engagement with the outside of the heated finger receiving mandrels. This rolling and turning of the fingers is accompanied by stretching as previously described. At the end of its travel, when the glove has been fully turned and is clear of the finger mounting members, the wrist clamp releases the glove.

It is preferred to provide a means for reducing the frictional forces experienced by the glove fingers during turning. If the turning is effected merely by the action of the moving wrist clamp pulling the finger portions of the glove against the edge of the finger receiving mandrels, large frictional forces will be experienced by the finger portions during turning. Particularly where the apparatus is operated at high speed, there is significant risk that these forces will be great enough to damage the gloves. Accordingly, the preferred apparatus of the invention includes means for reducing these frictional forces.

The preferred such means is a retractable member located inside the tubular finger receiving mandrel. The retractable member is urged outwardly, i.e. towards the finger mounting member. The retractable member is adapted to engage the end of the glove finger on the finger mounting member, when the finger receiving mandrel is moved to surround the glove finger. When the wrist clamp starts to turn the finger portions of the glove by pulling thereon, it is assisted by the outward thrust exerted by the retractable member on the end of the finger portion. This materially reduces the friction experienced by the finger portion as it turns around the end of the tubular mandrel. Further reductions in this friction are preferably accomplished, by providing the end portion of the tubular mandrel with a low friction surface (e.g. a TEFLON coating), and by arranging for a jet of air to be directed at the area of contact between the glove finger and the end of the tubular mandrel as turning of the finger proceeds.

The mandrels onto which the finger portions of the glove are turned determine in large part the size of the finished glove fingers. So that the apparatus may be used to produce gloves of different sizes, therefore, it is convenient to make the mandrels removable and replaceable with similar mandrels but of different sizes.

BRIEF DESCRIPTION OF THE DRAWINGS

A specific and preferred embodiment of an apparatus and process according to the present invention is illustrated in the accompanying drawings, in which:

In the drawings, like reference numerals indicate like parts.

With reference to FIGS. 1–3, these illustrate the objective which the present invention sets out to achieve. The finger 1 of a leather glove is commonly made from two separate pieces of leather 2, 3 stitched together to form bulky seams 4, 5. The glove is stitched in its inside out position as shown in FIG. 1. When it is turned to the right side out position as shown in FIG. 2, the seams 4, 5, project inwardly a substantial distance. It is now necessary to flatten these seams, and generally press the inside of the finger, to make the inside thereof conform to the desired shape. After this operation, known as blocking, the finger assumes the general inside cross sectional shape shown in FIG. 3, in which the seams 4, 5 have been flattened and the interior cavity expanded and shaped to the desired configuration. The subsequent drawings, FIGS. 4 through 12, illustrate an apparatus and process by which this is accomplished.

With reference to FIG. 4, the apparatus comprises a fixed framework having vertical side members 10, 11 and a cross member 12. A bed 13 is pivotally mounted at 14, 15 in the vertical side members 10, 11 respectively, for limited pivotal movement about a generally horizontal axis. The bed 13 carries on its underside two vertically disposed cylinders 16, 17 containing slidable piston rods 18, 19 which pass upwardly through apertures in the bed 13. Cylinders 16, 17 are connected to a source of pneumatic power, which can raise and lower the piston rods 18, 19 therein. The bed 13 has affixed to its upper surface an upwardly extending stem 20, carrying at its upper end a skeletal hand 21 with finger mounting members in the form of rods 22, 23, 24 and 25 projecting upwardly therefrom A movable table 26 is provided immediately above the bed 13. The table 26 is mounted on the upper ends of piston rods 18, 19 so that it can be raised and lowered in response to pneumatic pressure in cylinders 16, 17. The table 26 is provided, at each side, with vertically extending guide tubes 27, 28 fixed to the table 26 and passing through apertures in the bed 13, so that the guide tubes raise and lower with the table 26. The table 26 is also provided with a further aperture, near its center, to allow passage of hand stem 20 therethrough.

Figure 1:
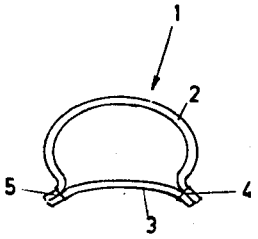
FIG. 1 is a diagrammatic cross section of a finger of an unfinished leather glove, after it has been stitched together but before turning from the inside out to the right side out condition.
Figure 2:
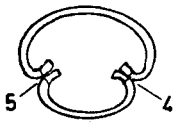
FIG. 2 is a diagrammatic cross section of the glove finger of FIG. 1, after turning but prior to blocking.
Figure 3:
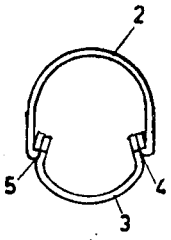
FIG. 3 is a diagrammatic cross section of the glove finger of FIG. 2 after blocking.

The table 26 is provided on its upper surface with a wrist clamp comprising a pair of interfitting metal channel members 29, 30, which are movable towards and away from each other, in a horizontal plane, relative to the table 26. Pneumatic cylinders 31, 33 with associated slidable piston rods 32, 34 are mounted on the upper surface of table 26. The piston rods 32, 34 are connected respectively to wrist clamp parts 29, 30, and can retract and expand the wrist clamp 29, 30 in response to pneumatic pressure in cylinders 31 and 33.

Vertical frame side member 10 is provided at its lower portion with an integral boss 35, to which is connected a pneumatic piston and cylinder arrangement 36, 37. The piston rod 37 connects via a crank arrangement 38 with the horizontal pivot 14 of the bed 13, so that the bed can be tilted by actuating cylinder 36.

A movable framework is provided, located generally above the bed 13, and movable in a vertical plane relative to the bed 13 and the fixed framework. The movable framework comprises an upper crosspiece 39 and a lower crosspiece 40. It also comprises vertical side rods 41, 42 secured to crosspieces 39, 40. Side rods 41, 42 pass through apertures in cross member 12 of the fixed framework, so that the lower portions of side rods 41, 42 are disposed inside but close to vertical side members 10, 11. The lower ends of side rods 41, 42 are vertically aligned with guide tubes 27, 28 respectively, associated with table 26, when the bed 13 and table 26 are in their normal, non-tilted position.

A pneumatic cylinder 43 is mounted on the upper surface of cross member 12 of the fixed framework, with its associated piston rod 44 extending vertically upward, and secured at its upper end to the middle of crosspiece 39 of the movable framework. This pneumatic cylinder 43 can be actuated to raise and lower the movable framework with respect to the fixed framework.

Compression springs 45, 46 are provided, seated in the upper surface of the cross member 12, and surrounding side rods 41, 42 respectively. The upper ends of the springs 45, 46 are adapted to be engaged by stop formations 47, 48 on respective side rods 41, 42 when the movable framework is lowered, to be compressed thereby when the movable framework is lowered to its full extent. The function and purpose of these springs 45, 46 is described hereinafter.

The lower crosspiece 40 of the movable framework carries on its upper surface an upstanding subsidiary frame with side walls 49, 50 and a head wall 51. Four tubular finger receiving mandrels 52, 53, 54, 55 extend downwardly through apertures in the crosspiece 40 in substantial longitudinal alignment with respective finger rods 22, 23, 24, 25 of the skeletal hand 21 associated with the fixed bed 13. The upper ends of tubular mandrels 52, 53, 54, 55 are received in the space defined by the subsidiary frame, and are secured to stop members 56, 57, 58, 59 respectively, which abut against the upper surface of crosspiece 40 and hence limit the downward protrusion of tubular mandrels 52, 53, 54, 55. The mandrels 52, 53, 54, 55 are slidable through the apertures in the crosspiece 40. Compression springs 60, 61, 62, 63 extend upwardly from stop members 56, 57, 58, 59 and are seated at their upper ends in the underside of head wall 51 of the subsidiary frame. The springs, 60, etc. urge their respective tubular mandrels 52, etc. downwardly, and hence urge stop members 56, etc. into abutment with crosspiece 40.

Figure 5:
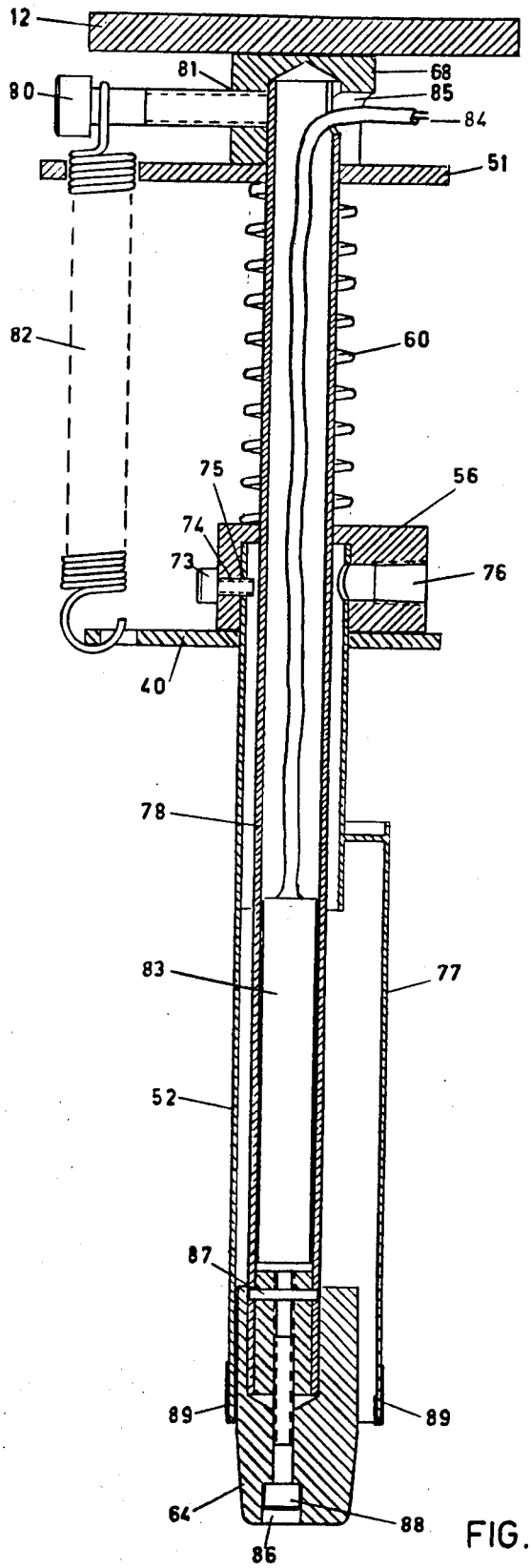
FIG. 5 is a longitudinal cross sectional view of a detail of the apparatus of FIG. 4.
Figure 4:
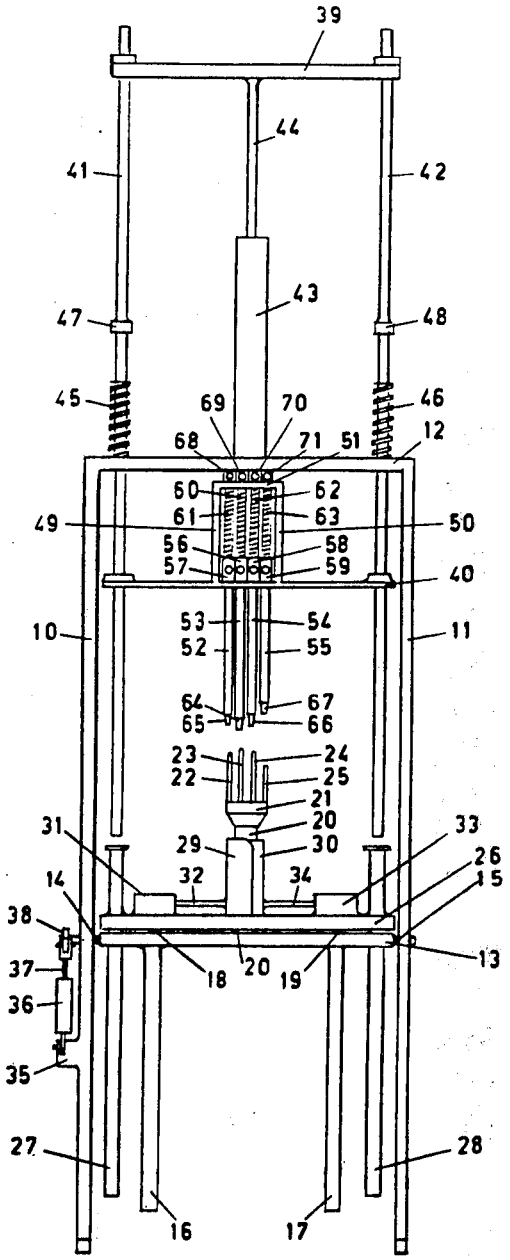
FIG. 4 is a somewhat diagrammatic front view of a glove turning and blocking apparatus according to the invention.
Figure 6:
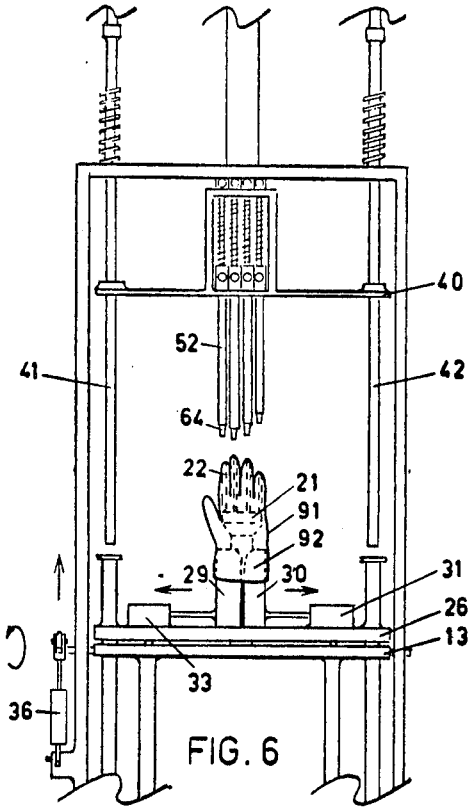
FIG. 6 is a front view of a portion of the apparatus of FIG. 4, in a first position of the operating cycle.
Figure 7:
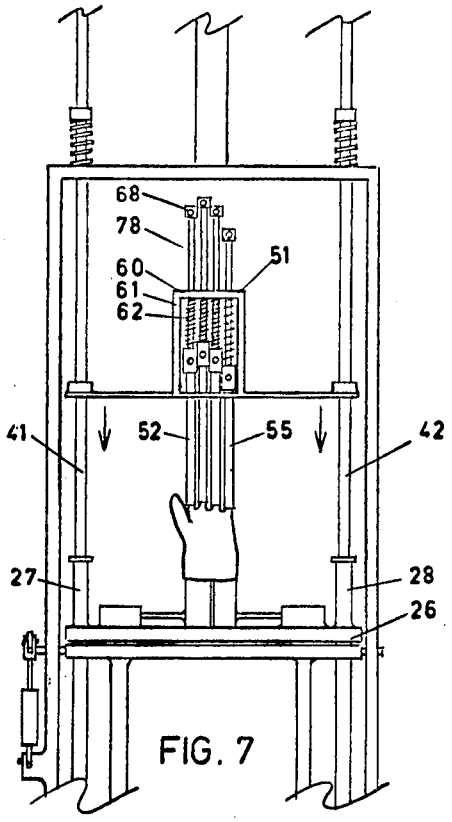
FIG. 7 is a view similar to FIG. 6, with the apparatus in a second position of the operating cycle.
Figure 8:
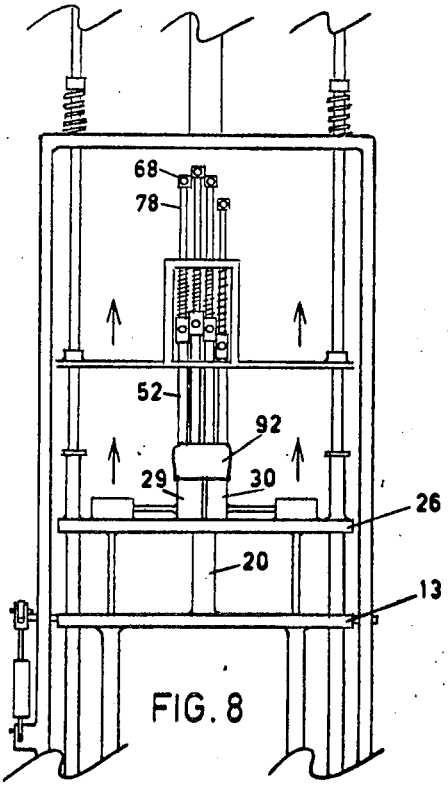
FIG. 8 is another view similar to FIG. 6, with the apparatus in a third position of the operating cycle.
Figure 9:
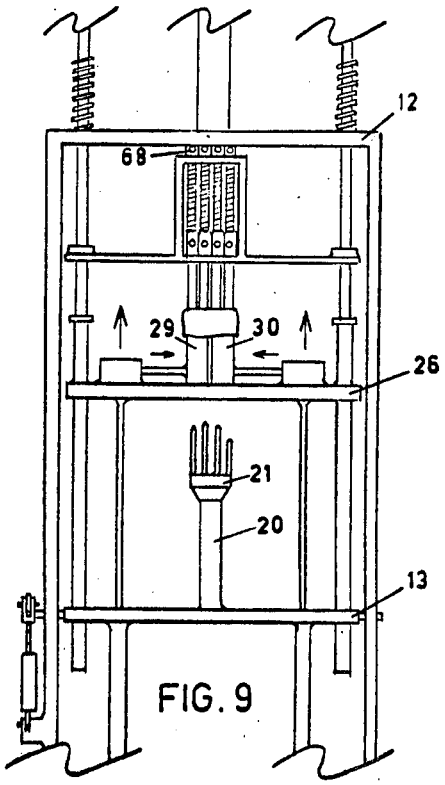
FIG. 9 is another view similar to FIG. 6 with the apparatus in a fourth position of the operating cycle.
Figure 10:
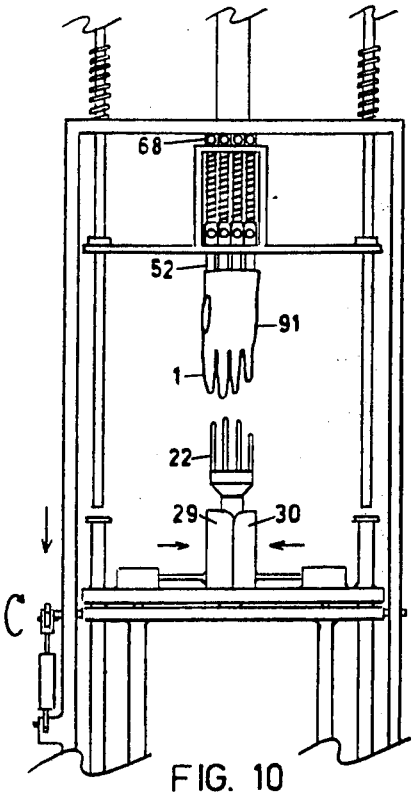
FIG. 10 is another view similar to FIG. 6 with the apparatus in a fifth position of the operating cycle.
Figure 11:
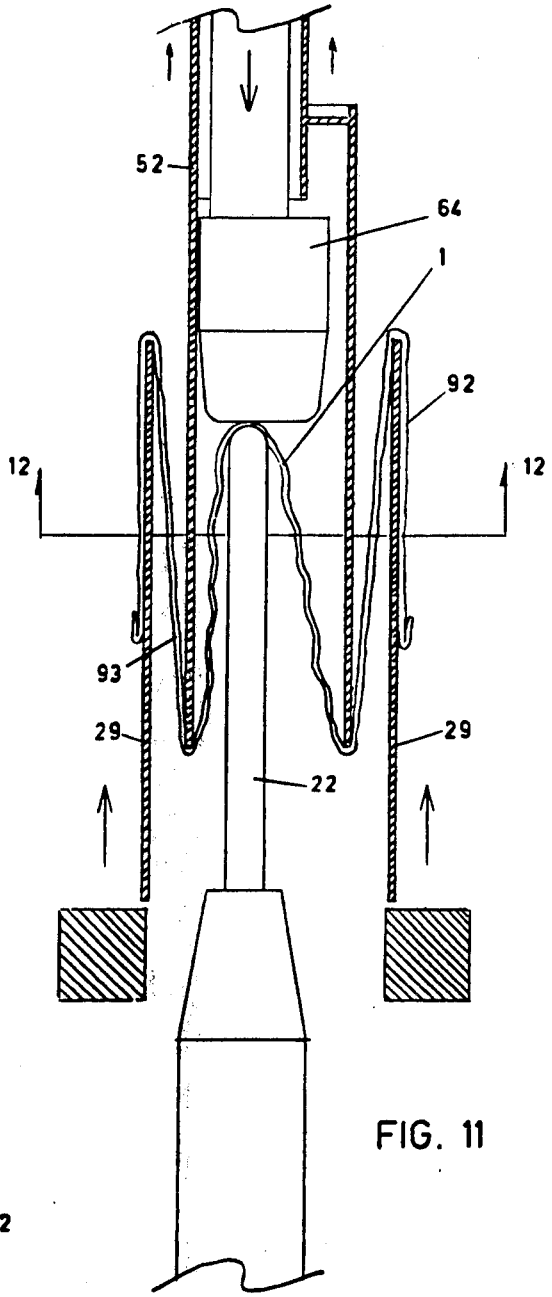
FIG. 11 is a diagrammatic longitudinal cross sectional view similar to FIG. 5, showing parts of the apparatus in the operating position of FIG. 8.

There are disposed within tubular mandrels 52, etc. respective retractable members in the form of slidable inner tubes 78 best shown in FIG. 5 the lower ends of which 64, 65, 66, 67 are bullet-like, and are visible in FIG. 4 protruding from the lower ends of the respective tubular mandrels 52, etc. The plungers extend upwardly within the tubular mandrels 52, etc. through associated stop members 56, etc. and associated compression springs 60, etc. and through apertures in the head wall 51, where they are received in respective stop members 68, 69, 70, 71 which abut against the upper surface of head wall 51. The retractable inner tubes 78 are also spring urged, by means shown in FIG. 5.

Now referring to FIG. 5, this illustrates in vertical cross section the tubular finger receiving mandrel 52 and associated parts, viewed from the side with respect to FIG. 4. It will be understood that the other mandrels 53, 54, 55 are essentially identical with the mandrel 52. At its upper end, the mandrel 52 extends through an aperture in lower crosspiece 40 of the movable framework. The upper end, above the crosspiece 40, is received in a stop member 56. The mandrel 52 is releasably secured to the stop member 56 by means of a screw 73 which is threadably received in a screw threaded aperture 74 in the side of the stop member 56 and extending into an aperture 75 in the side of the mandrel 52. The opposite side of the stop member 56 is provided with a horizontal bore 76 by means of which air pressure can be introduced to the interior of the mandrel 52. Compression spring 60 extends from the upper surface of the stop member 56 to the underside of the head wall 51 of the subsidiary frame of the movable framework, urging the stop member 56 and mandrel 52 in a downward direction. The lower part of the mandrel 52 is provided with a portion 77 of larger cross section.

Inside the mandrel 52 and extending longitudinally therethrough is the retractable inner tube 78 which terminates at its lower extremity in a removable bullet 64 extending below the end of the mandrel 52. The inner tube 78 and its associated parts are slidable within the mandrel 52. The tube 78 extends upwardly through an aperture in the stop member 56, within the coil spring 60, and through an aperture in head wall 51. At its upper end it is releasably received in stop member 68 by means of laterally extending screw 80 threadably received in a screw threaded aperture 81 and clamped against the side of the tube 78. A tension spring 82 extends from screw 80 to crosspiece 40 of the movable framework, thereby urging tube 78 and its associated parts downwardly relative to the movable framework. Downward movement is limited by abutment of stop member 68 against head wall 51.

Located within inner tube 78 near its bottom end is an electrical cartridge heater 83, the leads 84 from which pass upwardly inside the tube 78 and out of a lateral aperture 85 in the tube 78 and stop member 68, to a source of electrical heating power, not shown. The heater 83 is in contact with the tube 78, parts of which in turn contact mandrel 52 so that the entire lower portion of the mandrel assembly can be heated by means of cartridge heater 83.

The bullet 64 is of solid metal, namely aluminum, and is adapted to be removable from the tube 78. For this purpose, the bullet 64 is provided with a countersunk upwardly extending screw threaded bore 86. A closure plate 87 is provided near the bottom of the tube 78. The closure plate has a screw threaded aperture so that a screw 88 passing upwardly through the bore 86 of the bullet 64 attaches the bullet 64 releasably to the tube 78. It will be noted that, whilst the bullet 64 is of larger cross sectional area than the rest of the inner tube 78, there is still free space between the bullet 64 and the enlarged portion 77 of the mandrel. Thus a jet of air introduced through bore 76 has free communication with and exits from the bottom of the mandrel 52.

At its lower extremity, the tube 52 is provided on both its inner and outer surfaces and edge with a low friction coating 89 of TEFLON, to assist in the turning operations.

As noted, the glove fingers are received over the enlarged lower portion 77 of the mandrel 52 in operation, and according to the invention are stretched and blocked as they are received thereon. The mandrel 52 thus has an important role in determining the size of the finished glove. Tubular mandrel 52 is made removable from the apparatus, so that such mandrels of different sizes can be used, for use in turning different sized gloves. To remove mandrel 52, screw 86 is first unfastened and bullet 64 removed. Then screw 73 is unfastened, and tube 52 can then be removed downwardly from the assembly. An alternate tube is then inserted, screw 73 fastened and bullet 64 replaced.

Figure 12:
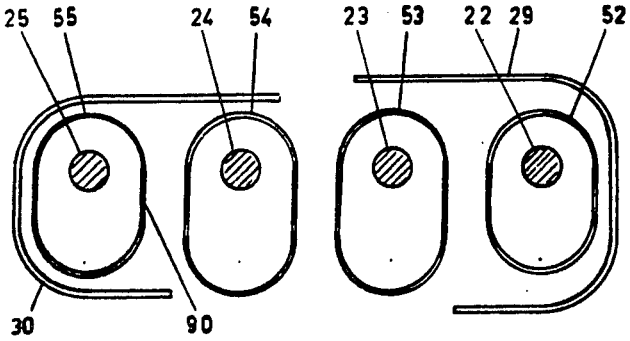
FIG. 12 is a diagrammatic cross sectional view of a detail of the machine, along the line 12—12 of FIG. 11, turned through 90° to show other finger receiving mandrels, and with the wrist clamp expanded.

With reference to FIG. 12, this shows in cross section the arrangement of the tubular mandrels 52, 53, 54, 55 at their enlarged lower portions. Their cross sectional shape is generally oval with straight longitudinal sides 90. Convenient and substantially constant spacing should be maintained between them, since they must align with the rods 22, 23, 24, 25 of the skeletal hand 21, and have sufficient spacing from one another to allow the turning of the fingers of the glove onto their exterior surfaces. Thus the curvature of the semicircular ends of the tubes 52, etc. is kept constant, to maintain constant width. The different sizes of tubes 52, etc. are arranged by providing tubes of different straight side 90 lengths. As shown in FIG. 12, for any given glove different sizes of tubes are used, and these are replaced with tubes of different straight side 90 lengths, for use with different glove sizes.

The operation of the machine as described herein will now be described, with reference to FIGS. 4 and 6 through 11.

Referring firstly to FIG. 4, at the start of the operating cycle the movable table 26 is at its lowermost position resting on the fixed bed 13. Pneumatic cylinder 36 is normally actuated to cause a forward tilting of the bed 13 and table 26 with associated parts including the skeletal hand 21. The extent of this tilt is limited by suitable stop means not shown. An inside out and unblocked glove 91 (seen in FIG. 6) is mounted on the skeletal hand 21. It will be noted that the finger rods 22, 23, 24 and 25 are of different lengths, to cooperate with the different lengths of the glove fingers, the pinky rod 25 being the shortest. The glove is mounted with the appropriate finger rods extending into the appropriate glove fingers, and with the cuff 92 of the glove 91 extending over the parts 29, 30 of the wrist clamp, which are at this stage in their retracted position. This forward tilted position of the skeletal hand 21 facilitates very greatly the operator's task in mounting the glove 91 thereon, and reduces risk of the operator's touching the heated mandrels 52, 53, 54, 55 during such loading. It also facilitates air blast-off removal, from the mandrels, of the glove turned and blocked during the previous machine cycle.

Next, the pneumatic pressure in cylinder 36 is switched, and the table 26 and bed 13 and associated parts tilt back to their vertical positions. Then cylinders 31 and 33 are actuated, to expand the wrist clamp 29, 30 inside the cuff 92 of the glove 91 so that the cuff 92 is firmly gripped. The apparatus is now in the position shown in FIG. 6.

The movable framework including the crosspiece 40 and tubular mandrels 52, 53, 54, 55 is now lowered with respect to the table 26 and bed 13 holding the skeletal hand. Tubular mandrels 52, 53, 54, 55 fit over the glove fingers mounted upon respective finger rods 22, 23, 24, 25. Proper vertical alignment is ensured by the cooperation of the lower ends of side rods 41,42 of the movable framework being received inside guide tubes 27,28 fixed to the table 26. If the alignment is incorrect, the rods 41,42 and the tubes 27,28 will abut and jam, preventing damaging engagement of the mandrels 52, 53, 54, 55 with the skeletal hand 21. The downward movement of the movable framework is set to a predetermined extent, defined by suitable limit switches, until the lower edge of the pinky tube mandrel 55 engages the bottom of the pinky finger of the glove. Since the pinky tube mandrel 55 has the longest distance of downward travel, there is extra motion of the other tubular mandrels 52, 53, 54 which is accommodated by compression of the respective springs 60, 61 and 62 associated with the other mandrels.

As the tubular mandrels 52 are pushed down over the glove fingers in this way, the bullets 64 engage the tops of the respective finger rods 22, 23, 24, 25 via the glove finger ends. They are retracted within the tubular mandrels 52 etc. against the urging of associated tension springs 82 (see FIG. 5) as the movable framework is moved downwardly. The upper ends of the inner tubes 78 bearing stop members 68 thus extend upwardly beyond the head wall 51 of the movable framework. The apparatus has now assumed the position shown in FIG. 7. During this downward travel of the movable framework including crosspiece 40 and tubular mandrels 52, 53, 54, 55 the stop formations 47 and 48 will engage springs 45 and 46. Compression of these springs together with elongation of the springs 82 will result in greatly reduced downward weight force of the movable frame, and hence reduce very substantially downward urging of tubular mandrels 52, 53, 54, 55.

Next, the downward force in cylinder 43 is stopped, and the table 26 moves upwardly relative to the bed 13 and skeletal hand 21. As it does so, it moves the wrist clamp 29, 30 upwardly in its expanded, glove engaging position. This causes turning to the right side out condition of the hand portion of the glove 91, about the top edge of the wrist clamp 29, 30 and the bottom edge of the tubular mandrels 52, 53, 54, 55.

Whilst this turning of the hand portion of the glove 91 is taking place, the tubular mandrels 52, 53, 54, 55, are effectively floating, being urged downwardly only by their associated respective springs 60, 61, 62, 63. The bullets 64, 65, 66, 67 press firmly on the tips of the glove finger being supported by the skeletal hand 21. The head wall 51 however, being part of the movable framework is at this point of the cycle just heavy enough to compress the springs 60, 61, 62, 63. The tubular mandrels 52 rest lightly at the bottom of the glove fingers. Turning of the hand portion of the glove 91 by upward movement of the wrist clamp 29,30 requires little force, and during such movement the tubular mandrels 52, 53, 54, 55 and bullets 64, 65, 66, 67 remain substantially stationary, maintained by their spring loadings. The hand portion turning is completed before turning of the finger portions commences. At this stage, the apparatus has assumed the positions shown in FIG. 8 and FIG. 11. The hand portion 93 of the glove is turned right side out and now lies inside the wrist clamp 29,30. The cuff 92 remains inside out, firmly gripped by and lying outside of the wrist clamp 29, 30. The finger 1 is inside out and has not started to turn. It rests on finger rod 22, and bullet 64 sits lightly thereon.

The force required to turn the finger 1 is considerably greater than the force required to turn hand portion 93. As wrist clamp 29,30 continues to move upwardly from its position shown in FIG. 8 and FIG. 11, and the finger 1 starts to turn, a jet of air is introduced through bore 76 into inner tube 78, from where the air passes out around the bottom of bullet 64 and around the bottom edge of tubular mandrel 52. This air jet combined with the TEFLON coated lower edge 89 of the tubular mandrel 52 reduces very substantially the frictional forces experienced by finger 1 during turning. The continued upward travel of wrist clamp 29,30 is against the light downward urging of the tubular mandrel 52 and the compression of the leather inside the mandrel 52, on account of slight upward travel of mandrel 52 and lack of movement of bullet 64. The compression springs 45 and 46 control the ease with which the tubular mandrel 52 will travel upwardly, controlling the compression of the leather between the bullet 64 and the edge of the tubular mandrel 52. The glove finger is consequently being turned due firstly to the compression forces exerted on the leather inside the tubular mandrel 52, aided by air pressure within the mandrel 52 which tends to urge the leather into contact with the rod 22, and due secondly to tension force on the leather outside the mandrel 52, over the bottom edge of mandrel 52 lubricated by the TEFLON coating 89 and the pressure of air. Glove finger 1 is thus being turned from a small diameter rod 22 to a larger diameter mandrel 52. Tubular mandrel 52 is heated as a result of the cartridge heater 83. This simultaneous stretching and heating as the glove finger is turned causes a substantial degree of blocking.

It will be appreciated that, in effect, turning of the glove is taking place in advance of the edge of the tube 52, due to the presence of the air jet previously described. The tube 52 is thus serving as a guide for the turning finger, and at this stage there is little if any contact between the edge of the tubular mandrel 52 and the glove finger being turned.

When the finger 1 has been turned for approximately three-fourths of its length, the air jet to bore 76 is cut off. Continued upward movement of the wrist clamp 29,30 causes the stop member 68 associated with the bullet 64 to come into abutment with frame cross member 12, whereupon it is positively held against further upward movement and can exert much greater downward force in response to upward movement of the wrist clamp 29,30. The bullet 64 now enters the end of the finger 1, contacting the leather thereof, as the end of the finger 1 is wholly removed from the rod 22 and transferred to the mandrel 52. Bullet 64 now extends below the end of tube 52, to receive the finger end and to block it. It will be noted that the end of bullet 64 is appropriately tapered to conform to the shape of the inside of the glove finger end. The apparatus is now in the position shown in FIG. 9.

A small degree of further upward travel of the wrist clamp 29,30, with the air exhausted on both sides of the cylinder 31 and 33 to relax the wrist clamp, completes the turning of the glove 91, by turning the cuff 92. Then the wrist clamp 29,30 on table 26 is withdrawn downwardly, leaving the glove 91 suspended on the mandrels 52, 53, 54, 55 where it is retained briefly so as to complete the blocking. This is the position of the apparatus illustrated in FIG. 10. Then the glove is removed from the machine, suitably by a blast of air from bore 76, and the machine is ready for a new cycle of operation.

The control means for the machine of the invention are not illustrated, but it will be appreciated that their design and operation are within the skill of the art. Thus a suitable interconnection of pneumatic pressure supplies and sequential operating controls is associated with pneumatic cylinders, 36, 16, 17, 31, 33 and 43 to arrange a cycle of operations as described herein. The apparatus cycles semi-automatically with the operator switching on the operating cycle after loading a glove onto skeletal hand 21 with the table 26 and bed 13 in their tilted forward position, whereupon the apparatus automatically completes a cycle and returns to this same position.

The apparatus can be operated at high speeds, with the entire cycle of automatic operation being completed in a period of from 10–30 seconds. To complete the blocking of the glove 91, it needs to remain in stretched contact with the heated tubular mandrels 52, 53, 54 and 55 only for a period of about 10 seconds. The mandrels 52 etc. can be heated to relatively high temperatures, such as 250°–500° F to accomplish the blocking, since the glove contacts them for only a brief interval.

Whilst the process and apparatus of the invention have been specifically described with reference to the making of leather gloves, it will be appreciated that it can be used with gloves of other, similar materials also. Gloves of a material which is preformed and requires parts to be stitched or otherwise secured together as seams, the material having the characteristic of stretching with a degree of resilience, can be made according to the invention.

The embodiments of the present invention described above are intended to be illustrative, preferred embodiments only, and the scope of the present invention is defined by the appended claims.

We claim:

1. A process of simultaneously turning and blocking at least one finger of a glove of leather or similar material, which comprises:

mounting a stitched glove with said at least one finger thereof in an inside-out condition over a finger mounting member of relatively small diameter, the stitched seams of the glove finger being presented outwardly;

turning the glove finger to its right side out condition and simultaneously pressing said stitched seams, by rolling said glove finger onto a heated exterior surface of a finger receiving mandrel of relatively larger diameter with simultaneous stretching of said finger;

bringing at least a major portion of the length of the stitched seams into contact with said heated exterior surface of the finger receiving mandrel with said finger in a stretched condition so as to press said stitched seams against said heated exterior surface;

and removing the glove from said finger receiving mandrel.

2. The process of claim 1 wherein said finger receiving mandrel is hollow, open ended and including the step of moving said finger receiving mandrel, with said open end leading, relatively towards said finger mounting member on which said glove finger is mounted so as to surround said mounted glove finger prior to having said glove finger transferred thereto.

3. The process of claim 2 which includes the steps of moving the finger receiving mandrel to surround the mounted glove finger, and then rolling the glove finger outwardly onto the finger receiving mandrel as the finger receiving mandrel is moved relatively away from the finger mounting member.

4. The process of claim 3 which includes the step of supplying air pressure between the end of said finger receiving mandrel and the portion of the glove finger being turned there onto.

5. The process of claim 4 including supplying a thrust to the end of the glove finger whilst the remainder of the glove finger is being turned, to assist in said turning.

6. The process of claim 4 wherein four fingers of a stitched inside out glove are simultaneously turned and blocked.

7. A process of turning and blocking a stitched inside out glove of leather or similar material which comprises the steps of:

mounting said glove, in an inside out condition, on a fixed skeletal hand having finger mounting members of rod-like form and relatively small diameter, with the finger mounting members extending inside and substantially to the ends of the fingers of the glove;

moving tubular mandrels, of relatively larger diameter, over the respective glove finger bearing finger mounting members so as substantially to surround the glove fingers;

exerting thrust on the glove finger ends;

gripping the wrist portion of the glove in clamping means adapted to move longitudinally of the skeletal hand;

moving said clamping means and wrist portion of the glove gripped thereby towards said tubular mandrels and thereby turning the hand portion of the glove to its right side out condition;

supplying a jet of air down the inside of said tubular mandrels between the end of the tubular mandrels and the finger portions of the glove;

heating the tubular mandrels;

continuing the moving of the clamping means and wrist portion of the glove away from the fixed skeletal hand so as to turn the finger portions of the glove onto the tubular mandrels;

increasing the thrust on the glove finger ends as the glove finger ends are turned;

releasing the clamping means and withdrawing it from engagement with the glove;

and removing the turned glove from the tubular mandrels by blow-off with air.

8. Apparatus for turning and blocking gloves comprising:

at least one finger mounting member of relatively small diameter adapted to be received inside a finger of a stitched, inside-out glove mounted thereon, at least one finger receiving mandrel of relatively larger diameter adapted to be arranged in substantial longitudinal alignment with said at least one finger mounting member, said finger receiving mandrel being of hollow open ended form, and being movable to surround said glove finger mounted on said finger mounting member, and being dimensioned so as to be a snug fit thereover;

and a wrist clamp for engaging a glove mounted on said at least one finger mounting member and transferring said glove finger by rolling it onto the outer surface of said at least one finger receiving mandrel with simultaneous stretching of said glove finger, said wrist clamp being expandable to grip the inside of the cuff of the glove, and retractable to release said glove, said wrist clamp being movable longitudinally relative to said at least one finger mounting member and relative to said finger receiving mandrel to transfer the finger of the glove from the finger mounting member to the finger receiving mandrel by rolling and reversing it thereonto.

9. Apparatus according to claim 8 including a skeletal hand having four finger mounting members protruding therefrom in substantially parallel relationship, and including four finger receiving mandrels adapted to be arranged in substantial alignment therewith.

10. Apparatus according to claim 9 wherein said skeletal hand is tiltable to bring the finger mounting members out of alignment with the finger receiving mandrels.

11. Apparatus according to claim 8 including means for heating the finger receiving mandrels.

12. Apparatus according to claim 11 wherein said finger receiving tubular mandrels are spring urged in a direction towards the skeletal hand, but retractable against such spring urging.

13. Apparatus according to claim 12 wherein said finger receiving tubular mandrels are removable and replaceable with other similar tubular mandrels of different sized external periphery, to accommodate glove fingers of different sizes.

14. Apparatus according to claim 11 including retractable means located inside the tubular finger receiving mandrels, said retractable means being urged outwardly towards said finger mounting members and adapted to engage the end of the respective glove finger on the respective finger mounting member when the tubular mandrels are moved to surround the mounted glove fingers.

15. Apparatus according to claim 14 wherein the retractable means comprises an inner tube slidable within the tubular mandrel, said inner tube containing a heater, and terminating at its outer end in an outwardly tapered releasable end block shaped to co-operate with the ends of the glove fingers.

16. Apparatus according to claim 14 including means for supplying streams of air between the outer ends of the tubular mandrels and the portions of the glove fingers being turned thereonto.

17. Apparatus according to claim 16 including a fixed bed to which the skeletal hand is secured in generally upwardly extending relation, and a movable table disposed above said fixed bed and to which the wrist clamp is secured, said movable table being movable in a vertical plane above said fixed bed.

18. Apparatus according to claim 17 including a movable framework with which the tubular finger receiving mandrels are operatively associated, said movable framework being movable with respect to both the fixed bed and the movable table, said movable framework and said movable table being provided with cooperable guide members adapted to cooperate when the tubular mandrels and finger mounting members are properly aligned, and to abut and prevent operation of the apparatus when the tubular mandrels and finger mounting members are out of proper alignment.

* * * * *